US007303003B2

(12) United States Patent
Ohhashi et al.

(10) Patent No.: US 7,303,003 B2
(45) Date of Patent: Dec. 4, 2007

(54) HEAT EXCHANGER

(75) Inventors: Hideo Ohhashi, Oyama (JP); Kouta Arino, Oyama (JP)

(73) Assignee: Showa Denko K.K., Tokyo (JP)

( * ) Notice: Subject to any disclaimer, the term of this patent is extended or adjusted under 35 U.S.C. 154(b) by 46 days.

(21) Appl. No.: 11/305,294

(22) Filed: Dec. 19, 2005

(65) Prior Publication Data

US 2006/0137870 A1 Jun. 29, 2006

Related U.S. Application Data

(60) Provisional application No. 60/640,047, filed on Dec. 30, 2004.

(30) Foreign Application Priority Data

Dec. 24, 2004 (JP) ..... 2004-372582

(51) Int. Cl.
*F28F 9/02* (2006.01)

(52) U.S. Cl. ..... 165/149

(58) Field of Classification Search ..... 165/110, 165/149, 173, 174, 176
See application file for complete search history.

(56) References Cited

U.S. PATENT DOCUMENTS 5,279,360 A * 1/1994 Hughes et al. ..... 165/111
5,320,165 A * 6/1994 Hughes ..... 165/153
5,481,800 A * 1/1996 Hutto et al. ..... 29/890.043
5,607,012 A * 3/1997 Buchanan et al. ..... 165/173
5,924,485 A * 7/1999 Kobayashi et al. ..... 165/173
7,066,243 B2 * 6/2006 Horiuchi et al. ..... 165/176

FOREIGN PATENT DOCUMENTS

JP 2003-214794 7/2003

* cited by examiner

*Primary Examiner*—Allen J. Flanigan
(74) *Attorney, Agent, or Firm*—Oblon, Spivak, McClelland, Maier & Neustadt, P.C.

(57) ABSTRACT

A heat exchanger employed as an evaporator includes a heat exchange core section and first to fourth headers 5, 6, 9, 11. The headers 5, 6 include hollow header bodies 10, 20 having opposite ends opened, and caps 18*a*, 18*b*, 19*a*, 19*b* fixed to the corresponding opposite end openings. The caps 18*a*, 18*b* have flat wall portions 32*a*, 33*a*, 34*a* which close the corresponding end openings of the header bodies 10, 20. A reinforcement projection portion 30 projecting toward the interior of the header 5 is formed on the flat wall portion 32*a* of the cap 18*a*. In the heat exchanger, the header 5 exhibits enhanced withstand pressure.

7 Claims, 8 Drawing Sheets

HEAT EXCHANGER

CROSS REFERENCE TO RELATED APPLICATIONS

This application is an application filed under 35 U.S.C. § 111(a) claiming the benefit pursuant to 35 U.S.C. § 119(e)(1) of the filing date of Provisional Application No. 60/640,047 filed Dec. 30, 2004 pursuant to 35 U.S.C. § 111(b).

BACKGROUND OF THE INVENTION

1. Field of the Invention

The present invention relates to a heat exchanger preferably used as an evaporator of a car air conditioner, which is a refrigeration cycle to be mounted on, for example, an automobile.

2. Description of the Related Art

Conventionally, a so-called laminated evaporator has been widely employed as an evaporator for use in a car air conditioner. In the laminated evaporator, a plurality of flat, hollow members, each of which includes a pair of depressed plates facing each other and brazed to each other at their peripheral edge portions, are arranged in parallel, and corrugate fins are each disposed between and brazed to the adjacent flat, hollow members.

In recent years, evaporators have been required to be further reduced in size and weight and to exhibit higher performance. A known evaporator which fulfills these requirements includes a heat exchange core section configured such that heat exchange tube groups are arranged in two rows in an air flow direction, each heat exchange tube group consisting of a plurality of heat exchange tubes arranged at predetermined intervals; a first header which is disposed on a first-end side of the heat exchange tubes and to which the heat exchange tubes of one heat exchange tube group are connected; a second header which is disposed on the first-end side of the heat exchange tubes and upstream of the first header with respect to the air flow direction and to which the heat exchange tubes of the other heat exchange tube group are connected; a third header which is disposed on a second-end side of the heat exchange tubes and to which the heat exchange tubes connected to the first header are connected; and a fourth header which is disposed on the second-end side of the heat exchange tubes and to which the heat exchange tubes connected to the second header are connected. A refrigerant inlet is formed at a first end portion of the first header, and a refrigerant outlet is formed at an end portion, which corresponds to the first end portion of the first header, of the second header. A partition wall divides the interiors of the first and second headers at longitudinally intermediate portions. A refrigerant which flows into the first header passes through all the heat exchange tubes and all the headers and then flows out from the refrigerant outlet (refer to Japanese Patent Application Laid-Open (kokai) No. 2003-214794).

In the evaporator described in the above publication, the headers each include a header body which is composed of a header tank and a header plate and whose opposite ends are opened. End openings of the header bodies of the first and second headers in opposition to end openings where the refrigerant inlet and the refrigerant outlet are formed, and opposite end openings of the header bodies of the third and fourth headers, are closed by corresponding flat wall portions of caps fixed to the ends of the header bodies.

The evaporator described in the publication is required to exhibit further enhanced header withstand pressure.

SUMMARY OF THE INVENTION

An object of the present invention is to solve the above problem and to provide a heat exchanger whose headers exhibit enhanced withstand pressure.

To achieve the above object, the present invention comprises the following modes.

1) A heat exchanger comprising two headers spaced apart from each other and a plurality of heat exchange tubes which are disposed between the two headers at predetermined intervals along a longitudinal direction of the headers and whose opposite end portions are connected to the corresponding headers, wherein the two headers each comprise a hollow header body having opposite ends opened, and caps each having a flat wall portion and fixed to the corresponding opposite ends of the header body, the flat wall portions closing the corresponding opposite end openings of the header body; and a reinforcement projection portion projecting toward the interior of the header is formed on the flat wall portion of at least one of the caps.

2) A heat exchanger according to par. 1), wherein the reinforcement projection portion is formed on the flat wall portion having a projected area of 150 $mm^2$ or more.

3) A heat exchanger according to par. 2), wherein the reinforcement projection portion is formed on the flat wall portion having a projected area of 200 $mm^2$ or more.

4) A heat exchanger according to par. 2), wherein the projected area of the reinforcement projection portion is 2.8% or more the projected area of the flat wall portion.

5) A heat exchanger according to par. 4), wherein the projected area of the reinforcement projection portion is 50% or less the projected area of the flat wall portion.

6) A heat exchanger according to par. 1), wherein the reinforcement projection portion assumes the form of a partial sphere which partially constitutes a sphere.

7) A heat exchanger according to par. 1), wherein the caps each have a recess portion to be fitted into the header body, and bottom walls of the recess portions serve as the flat wall portions which close the corresponding opposite end openings of the header bodies.

8) A heat exchanger comprising a heat exchange core section configured such that heat exchange tube groups are arranged in a plurality of rows in an air flow direction, each heat exchange tube group consisting of a plurality of heat exchange tubes arranged at predetermined intervals, a first header which is disposed on a first-end side of the heat exchange tubes and to which the heat exchange tubes of at least one heat exchange tube group are connected, a second header which is disposed on the first-end side of the heat exchange tubes and upstream of the first header with respect to the air flow direction and to which the heat exchange tubes of the remaining heat exchange tube groups are connected, a third header which is disposed on a second-end side of the heat exchange tubes and to which the heat exchange tubes connected to the first header are connected, and a fourth header which is disposed on the second-end side of the heat exchange tubes and to which the heat exchange tubes connected to the second header are connected, wherein the headers each comprise a hollow header body having opposite ends opened, and caps each having a flat wall portion and fixed to the corresponding opposite ends of the header body, the flat wall portions closing the corresponding opposite end openings of the header body; and a reinforcement projection portion projecting toward the interior of the header is formed on the flat wall portion of at least one of the caps.

9) A heat exchanger according to par. 8), wherein the reinforcement projection portion is formed on the flat wall portion having a projected area of 150 $mm^2$ or more.

10) A heat exchanger according to par. 9), wherein the reinforcement projection portion is formed on the flat wall portion having a projected area of 200 $mm^2$ or more.

11) A heat exchanger according to par. 9), wherein the projected area of the reinforcement projection portion is 2.8% or more the projected area of the flat wall portion.

12) A heat exchanger according to par. 11), wherein the projected area of the reinforcement projection portion is 50% or less the projected area of the flat wall portion.

13) A heat exchanger according to par. 8), wherein the reinforcement projection portion assumes the form of a partial sphere which partially constitutes a sphere.

14) A heat exchanger according to par. 8), wherein the caps each have a recess portion to be fitted into the header body, and bottom walls of the recess portions serve as the flat wall portions which close the corresponding opposite end openings of the header bodies.

15) A heat exchanger according to par. 8), wherein a refrigerant inlet is formed in the cap which closes a first end opening of the header body of the first header; a refrigerant outlet is formed in the cap which closes an end opening, which corresponds to the first end opening of the header body of the first header, of the header body of the second header; the third header and the fourth header communicate with each other; and the reinforcement projection portion is formed on the flat wall portion of the cap which closes the end opening opposite the refrigerant inlet of the header body of the first header.

16) A heat exchanger according to par. 15), wherein partition means extending horizontally divides the interior of the second header into a first space and a second space; the heat exchange tubes are connected to the second header in such a manner as to communicate with the first space; refrigerant passage holes are formed in the partition means; the second space of the second header communicates with the refrigerant outlet; a recess portion to be fitted into the first space and a recess portion to be fitted into the second space are formed on the two caps which close the corresponding opposite end openings of the header body of the second header; and bottom walls of the recess portions serve as the flat wall portions which close the corresponding opposite end openings of the header body.

Each of the above-mentioned heat exchangers is preferably used as an evaporator in a refrigeration cycle which includes a compressor, a condenser, and an evaporator. The refrigeration cycle is mounted as, for example, an air conditioner, on a vehicle.

In the heat exchanger of par. 1) or 8), the headers each comprise the hollow header body having opposite ends opened, and the caps each having the flat wall portion and fixed to the corresponding opposite ends of the header body, the flat wall portions closing the corresponding opposite end openings of the header body; and the reinforcement projection portion projecting toward the interior of the header is formed on the flat wall portion of at least one of the caps. Thus, withstand pressure of the entire heat exchanger is enhanced. Even when the internal pressure of the heat exchanger increases, there can be prevented deformation of the flat wall portion of the cap on which the reinforcement projection portion is formed, as well as leakage which could otherwise result from the deformation.

In the case where the projected area of a flat wall portion of a cap is 150 $mm^2$ or more as in the case of the heat exchanger of par. 2) or 9), there is risk of a drop in withstand pressure of the flat wall portion. Even in this case, formation of a reinforcement projection portion on the flat wall portion enhances withstand pressure of the flat wall portion of the cap.

In the case where the projected area of a flat wall portion of a cap is 200 $mm^2$ or more as in the case of the heat exchanger of par. 3) or 10), there is risk of a significant drop in withstand pressure of the flat wall portion. Even in this case, formation of a reinforcement projection portion on the flat wall portion enhances withstand pressure of the flat wall portion of the cap.

With the heat exchanger of par. 4), 5), 11), or 12), withstand pressure of the flat wall portion of the cap is reliably enhanced.

With the heat exchanger of par. 6) or 13), the effect of enhancing withstand pressure of the flat wall portion of the cap is enhanced.

DESCRIPTION OF PREFERRED EMBODIMENT

An embodiment of the present invention will next be described in detail with reference to the drawings.

In the following description, the term "aluminum" includes aluminum alloys in addition to pure aluminum. Also, in the following description, the downstream side (a direction represented by arrow X in FIG. 1, right-hand side of FIG. 3) of an air flow through air-passing clearances between adjacent heat exchange tubes will be referred to as the "front," and the opposite side as the "rear." The upper, lower, left-hand, and right-hand sides of FIG. 1 will be referred to as "upper," "lower," "left," and "right," respectively.

Figure 1:
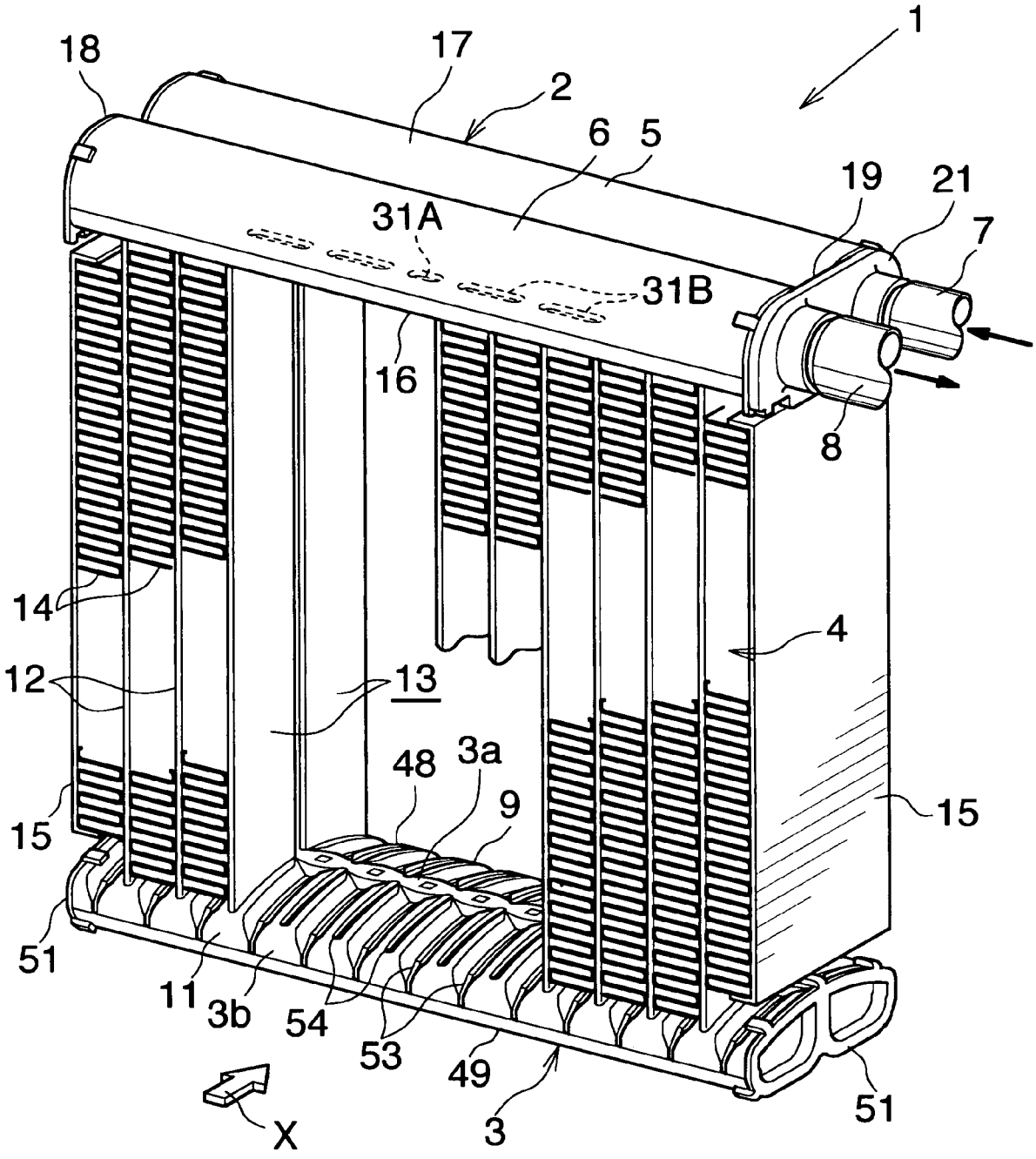
FIG. 1 is a partially cut-away perspective view showing the overall configuration of an evaporator according to the present invention.

FIG. 1 shows an evaporator for use in a car air conditioner to which the present invention is applied. FIGS. 2 to 7 show the configuration of essential portions of the evaporator. FIG. 8 shows how a refrigerant flows in the evaporator.

In FIG. 1, the evaporator (1), which is used in a car air conditioner using a chlorofluorocarbon-based refrigerant, includes a refrigerant inlet/outlet tank (2) made of aluminum and a refrigerant turn tank (3) made of aluminum, the tanks (2) and (3) being vertically spaced apart from each other, and further includes a heat exchange core section (4) provided between the tanks (2) and (3).

The refrigerant inlet/outlet tank (2) includes a refrigerant inlet header (5) (first header) located on a side toward the front (downstream side with respect to the air flow direction) and a refrigerant outlet header (6) (second header) located on a side toward the rear (upstream side with respect to the air flow direction). The headers (5) and (6) are integrated with each other via connection means, which will be described later. A refrigerant inlet pipe (7) made of aluminum is connected to the refrigerant inlet header (5) of the refrigerant inlet/outlet tank (2). A refrigerant outlet pipe (8) made of aluminum is connected to the refrigerant outlet header (6). The refrigerant turn tank (3) includes a refrigerant inflow header (9) (third header) located on the side toward the front and a refrigerant outflow header (11) (fourth header) located on the side toward the rear. The headers (9) and (11) are integrated with each other via connection means, which will be described later.

The heat exchange core section (4) is configured such that heat exchange tube groups (13) are arranged in a plurality of; herein, two, rows in the front-rear direction, each heat exchange tube group (13) consisting of a plurality of heat exchange tubes (12) made of aluminum and arranged in parallel at predetermined intervals in the left-right direction. Corrugate fins (14) made of aluminum are disposed within air-passing clearances between the adjacent heat exchange tubes (12) of the heat exchange tube groups (13) and on the outer sides of the leftmost and rightmost heat exchange tubes (12) of the heat exchange tube groups (13), and are brazed to the corresponding heat exchange tubes (12). Side plates (15) made of aluminum are disposed on the outer sides of the leftmost and rightmost corrugate fins (14), and are brazed to the corresponding corrugate fins (14). The upper and lower ends of the heat exchange tubes (12) of the front heat exchange tube group (13) are connected to the refrigerant inlet header (5) and the refrigerant inflow header (9), respectively, whereby the heat exchange tubes (12) form a forward refrigerant flow section. The upper and lower ends of the heat exchange tubes (12) of the rear heat exchange tube group (13) are connected to the refrigerant outlet header (6) and the refrigerant outflow header (11), respectively, whereby the heat exchange tubes (12) form a return refrigerant flow section.

Figure 2:
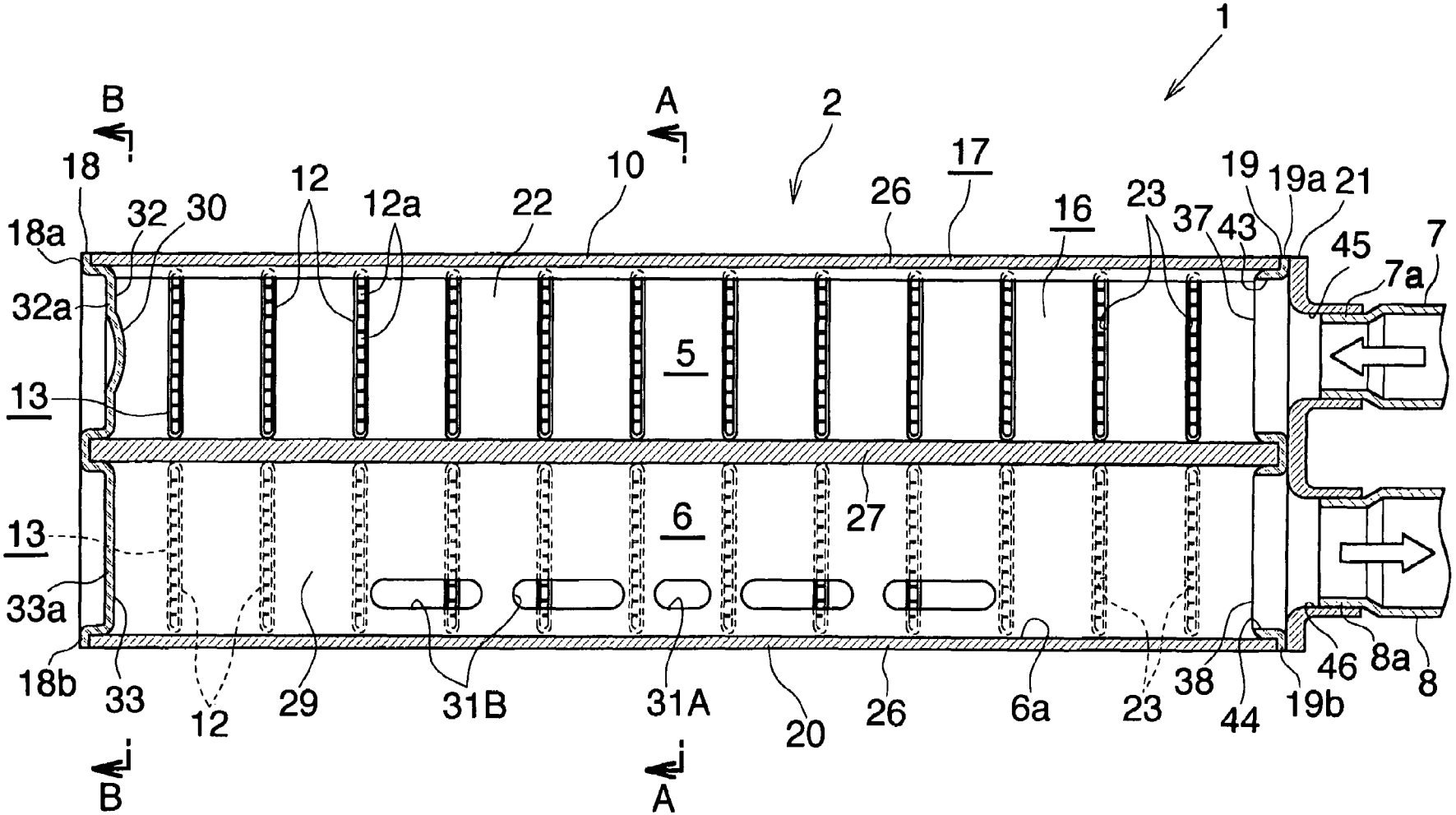
FIG. 2 is a horizontal sectional view of a refrigerant inlet/outlet tank of the evaporator shown in FIG. 1.
Figure 3:
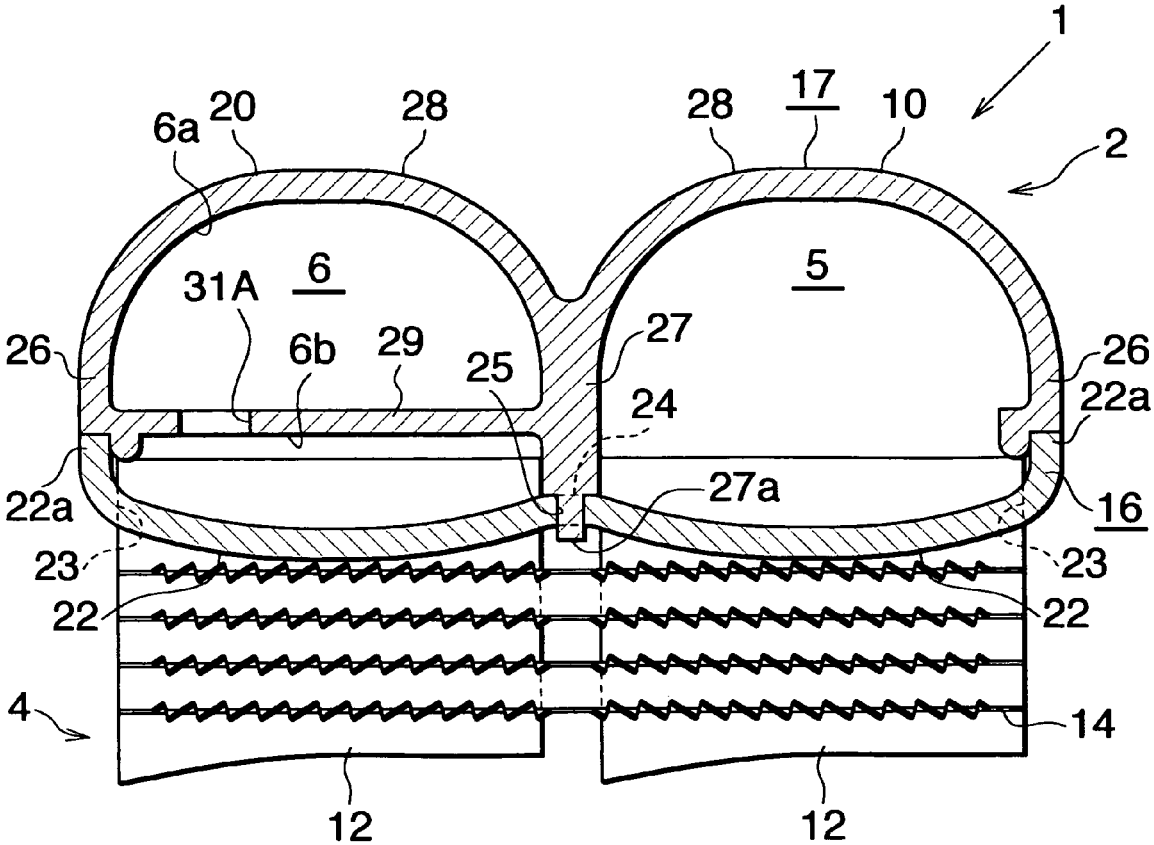
FIG. 3 is an enlarged fragmentary view in section taken along line A-A of FIG. 2.
Figure 3:
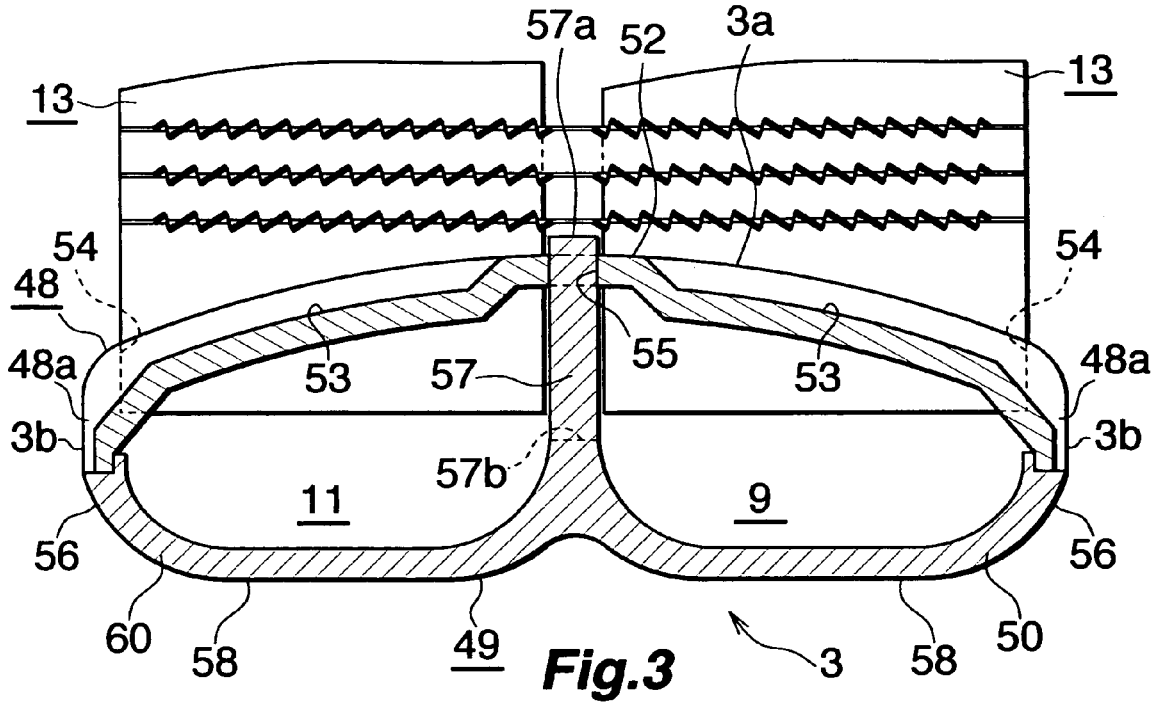
Figure 4:
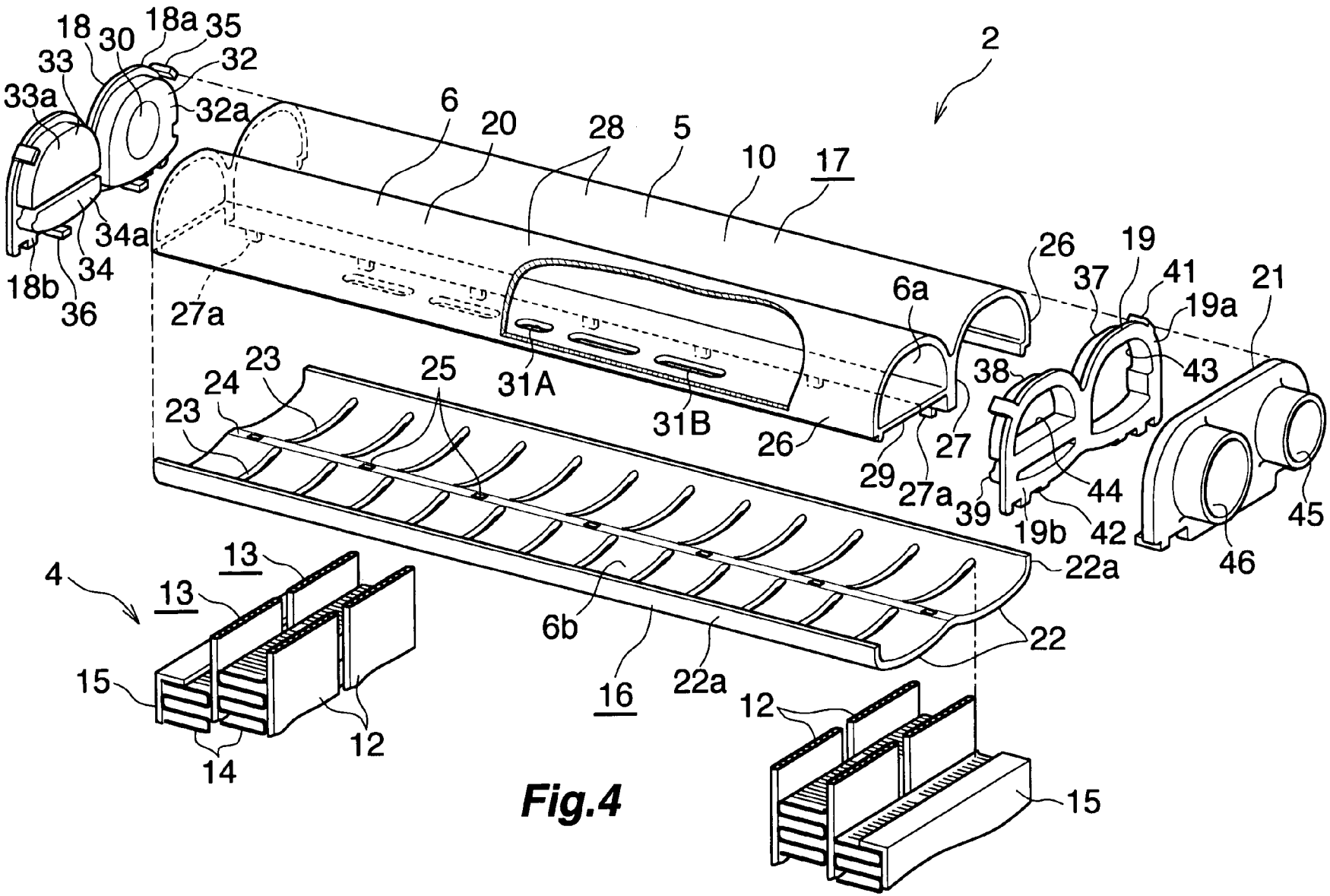
FIG. 4 is an exploded perspective view of the refrigerant inlet/outlet tank of the evaporator shown in FIG. 1.

As shown in FIGS. 2 to 4, the refrigerant inlet/outlet tank (2) is formed from an aluminum brazing sheet having a brazing material layer on each of opposite sides thereof, and includes a first member (16) having a plate-like shape and to which the heat exchange tubes (12) are connected, and a second member (17) formed from a bare aluminum extrudate and covering the upper side of the first member (16).

The first member (16) has front and rear curved portions (22), whose central regions each have an arcuate cross section projecting downward and having a small curvature. A plurality of tube insertion holes (23), which are elongated in the front-rear direction, are formed in the curved portions (22) at predetermined intervals in the left-right direction. The tube insertion holes (23) of the front curved portion (22) and those of the rear curved portion (22) are identical in position in the left-right direction. A rising wall (22*a*) is formed integrally with each of the front edge of the front curved portion (22) and the rear edge of the rear curved portion (22), over the entire length of the front and rear edges. A flat portion (24), which serves as means for connecting together the refrigerant inlet header (5) and the refrigerant outlet header (6), is formed between the curved portions (22) of the first member (16). A plurality of through holes (25) are formed in the flat portion (24) at predetermined intervals in the left-right direction.

The second member (17) has a cross section resembling the letter m, which opens downward, and includes front and rear walls (26) extending in the left-right direction; a vertical, intermediate wall (27) provided at a central portion thereof between the front and rear walls (26), extending in the left-right direction, and serving as means for connecting together the refrigerant inlet header (5) and the refrigerant outlet header (6); and two substantially arcuate connection walls (28) projecting upward and integrally connecting the upper end of the intermediate wall (27) and the upper ends of the front and rear walls (26). A flow-dividing resistance plate (29), which serves as partition means for dividing the interior of the refrigerant outlet header (6) into an upper space and an lower space, integrally connects a lower end portion of the rear wall (26) of the second member (17) and a lower end portion of the intermediate wall (27) over the entire length thereof. A plurality of refrigerant passage holes (31A) and (31B) in a through-hole form and elongated in the left-right direction are formed in a rear region, excluding left and right end portions thereof, of the flow-dividing resistance plate (29) at predetermined intervals in the left-right direction. The lower end of the intermediate wall (27) projects downward beyond the lower ends of the front and rear walls (26). A plurality of projections (27*a*) are integrally formed on the lower end face of the intermediate wall (27) at predetermined intervals in the left-right direction in such a manner as to project downward, and are fitted into corresponding through holes (25) of the first member (16). The projections (27*a*) are formed by cutting off predetermined portions of the intermediate wall (27).

The front curved portion (22) and the flat portion (24) of the first member (16), and the front wall (26), the intermediate wall (27), and the front connection wall (28) of the second member (17) form a hollow header body (10), whose left and right ends are opened, of the refrigerant inlet header (5). The rear curved portion (22) and the flat portion (24) of the first member (16), and the rear wall (26), the intermediate wall (27), and the rear connection wall (28) of the second member (17) form a hollow header body (20), whose left and right ends are opened, of the refrigerant outlet header (6). The header bodies (10) and (20) are united together via connection means composed of the flat portion (24) and the intermediate wall (27).

The right end openings of the header bodies (10) and (20) are closed by a right-hand closing member (19) formed from an aluminum brazing sheet having a brazing material layer on each of opposite sides thereof. A plate-like pipe joint member (21) made of aluminum and elongated in the front-rear direction is brazed to the outer surface of the right-hand closing member (19). The left end openings of the header bodies (10) and (20) are closed by a left-hand closing member (18) formed from an aluminum brazing sheet having a brazing material layer on each of opposite sides thereof.

Figure 5:
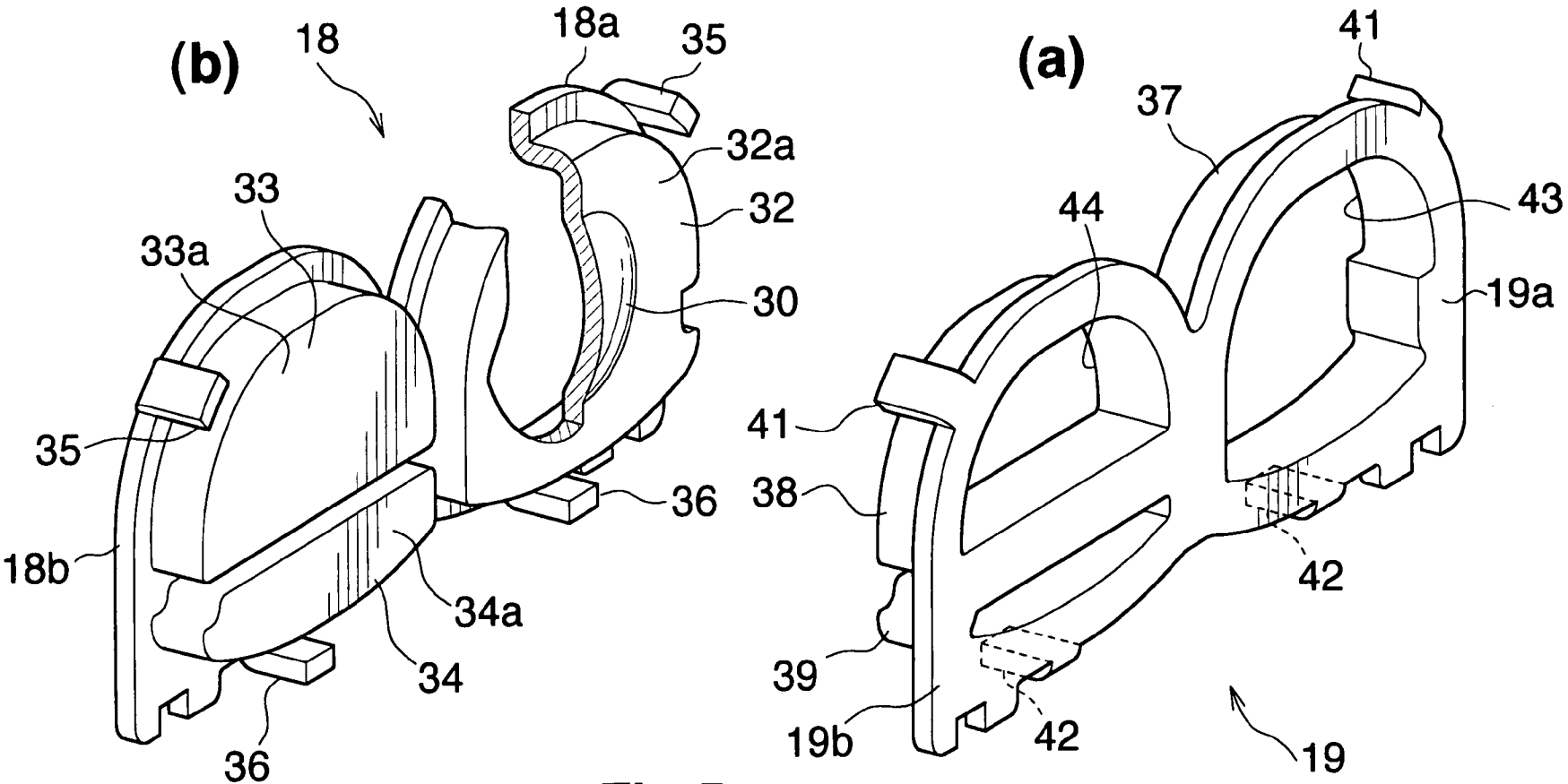
FIG. 5 shows two closing members for the refrigerant inlet/outlet tank of the evaporator shown in FIG. 1, wherein (a) is a perspective view showing a right-hand closing member, and (b) is a partially cut-away perspective view showing a left-hand closing member.

As shown in FIG. 5, the right-hand closing member (19) is configured such that a front cap (19*a*) and a rear cap (19*b*) are integrated with each other. The front cap (19*a*) closes the right end opening of the header body (10) of the refrigerant inlet header (5). The rear cap (19*b*) closes the right end opening of the header body (20) of the refrigerant outlet header (6). A leftward projecting recess portion (37) to be fitted into the header body (10) of the refrigerant inlet header (5) is formed integrally with the front cap (19*a*) of the right-hand closing member (19). A leftward projecting upper recess portion (38) and a leftward projecting lower recess portion (39) are formed integrally with the rear cap (19*b*) and are spaced apart from each other in the vertical direction. The leftward projecting upper recess portion (38) is fitted into a space (6*a*) of the header body (20) of the refrigerant outlet header (6), the space (6*a*) being located above the flow-dividing resistance plate (29). The leftward projecting lower recess portion (39) is fitted into a space (6*b*) of the header body (20) of the refrigerant outlet header (6), the space (6*b*) being located under the flow-dividing resistance plate (29). The bottom walls of the recess portions (37), (38), and (39) serve as flat wall portions which close the right end openings of the header bodies (10) and (20). The flat wall portion of the front recess portion (37) of the right-hand closing member (19) is entirely stamped out, thereby forming a refrigerant inlet (43). The flat wall portion of the rear, upper recess portion (38) of the right-hand closing member (19) is entirely stamped out, thereby forming a refrigerant outlet (44). An engagement finger (41) projecting leftward and engaging with the corresponding connection wall (28) of the second member (17) is formed integrally with each of an arcuate portion extending between the front side edge and the top edge of the right-hand closing member (19) and an arcuate portion extending between the rear side edge and the top edge of the right-hand closing member (19). Similarly, an engagement finger (42) projecting leftward and engaging with the corresponding curved portion (22) of the first member (16) is formed integrally with each of a front portion and a rear portion of the lower end face of the right-hand closing member (19).

The pipe joint member (21) includes an integrally formed short, cylindrical refrigerant inflow port (45) (refrigerant inflow portion) communicating with the refrigerant inlet (43) of the right-hand closing member (19), and an integrally formed short, cylindrical refrigerant outflow port (46) (refrigerant outflow portion) communicating with the refrigerant outlet (44) of the right-hand closing member (19). A diameter-reduced portion (7*a*) formed at one end portion of the refrigerant inlet pipe (7) is inserted into and brazed to the refrigerant inflow port (45) of the pipe joint member (21). Similarly, a diameter-reduced portion (8*a*) formed at one end portion of the refrigerant outlet pipe (8) is inserted into and brazed to the refrigerant outflow port (46) of the pipe joint member (21). Although unillustrated, an expansion valve attachment member is joined to the other end portions of the refrigerant inlet and outlet pipes (7) and (8) while facing the ends of the pipes (7) and (8).

Figure 6:
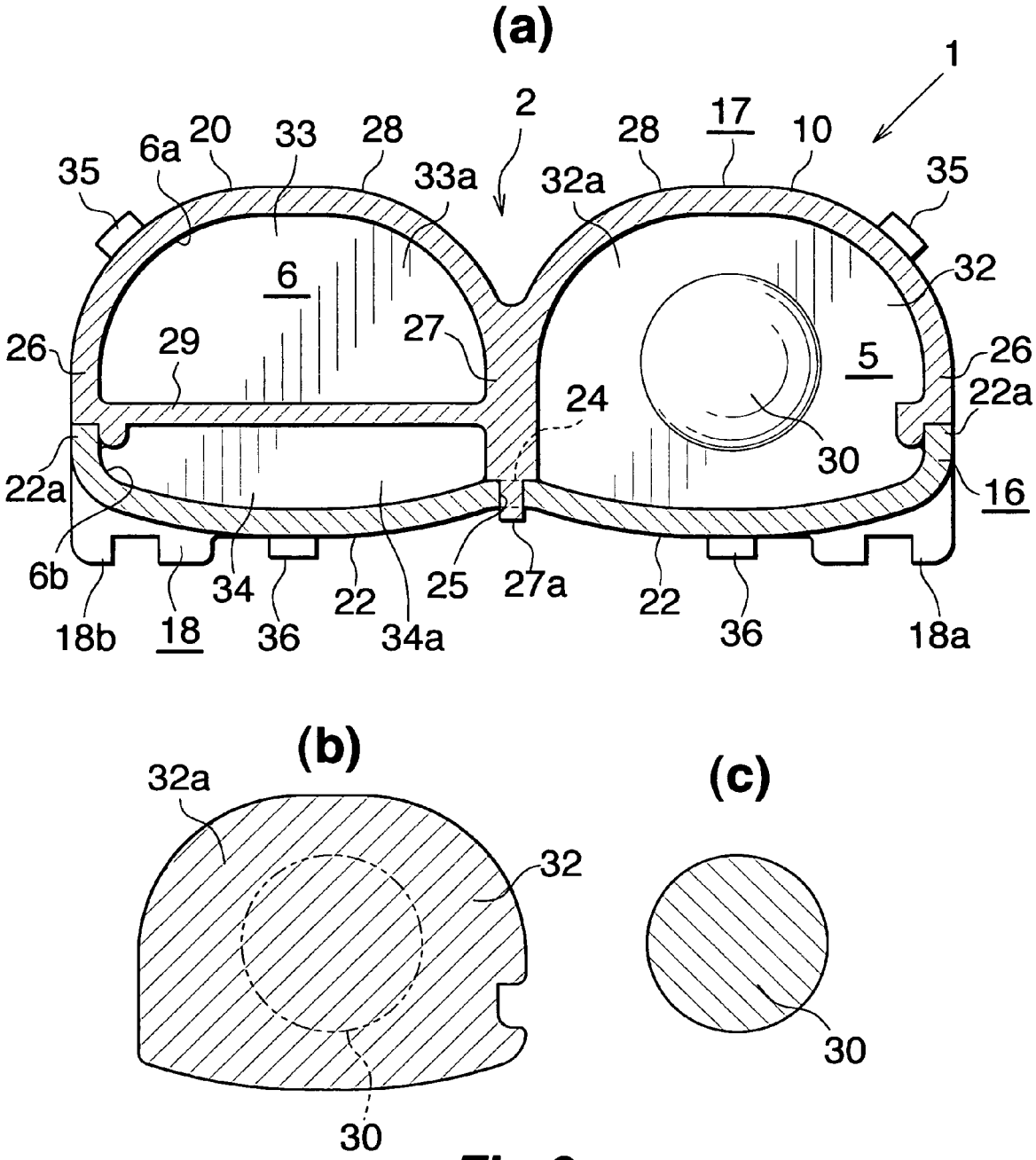
FIG. 6 shows the left-hand closing member of the refrigerant inlet/outlet tank of the evaporator shown in FIG. 1, wherein (a) is an enlarged sectional view taken along line B-B of FIG. 2, (b) is an explanatory view showing a flat wall portion of a front cap, and (c) is an explanatory view showing a reinforcement projection portion of the flat wall portion of the front cap.

As shown in FIGS. 5 and 6, the left-hand closing member (18) is configured such that a front cap (18*a*) and a rear cap (18*b*) are integrated with each other. The front cap (18*a*) closes the left end opening of the header body (10) of the refrigerant inlet header (5). The rear cap (18*b*) closes the left end opening of the header body (20) of the refrigerant outlet header (6). A rightward projecting recess portion (32) to be fitted into the header body (10) of the refrigerant inlet header (5) is formed integrally with the front cap (18*a*) of the left-hand closing member (18). A rightward projecting upper recess portion (33) and a rightward projecting lower recess portion (34) are formed integrally with the rear cap (18*b*) and are spaced apart from each other in the vertical direction. The rightward projecting upper recess portion (33) is fitted into the space (6*a*) of the header body (20) of the refrigerant outlet header (6), the space (6*a*) being located above the flow-dividing resistance plate (29). The rightward projecting lower recess portion (34) is fitted into the space (6*b*) of the header body (20) of the refrigerant outlet header (6), the space (6*b*) being located under the flow-dividing resistance plate (29). The bottom walls of the recess portions (32), (33), and (34) serve as flat wall portions (32*a*), (33*a*), and (34*a*), respectively, which close the left end openings of the header bodies (10) and (20). An engagement finger (35) projecting rightward and engaging with the corresponding connection wall (28) of the second member (17) is formed integrally with each of an arcuate portion extending between the front side edge and the top edge of the left-hand closing member (18) and an arcuate portion extending between the rear side edge and the top edge of the left-hand closing member (18). Similarly, an engagement finger (36) projecting rightward and engaging with the corresponding curved portion (22) of the first member (16) is formed integrally with each of a front portion and a rear portion of the lower end face of the left-hand closing member (19).

A reinforcement projection portion (30) projecting toward the interior of the refrigerant inlet header (5) is formed on the bottom wall of the recess portion (32) of the front cap (18*a*) of the left-hand closing member (18); i.e., on the flat wall portion (32*a*) which closes the left end opening of the header body (10), by means of deforming the flat wall portion (32*a*) inwardly. The projected area (the area of a hatched portion in FIG. 6(*b*)) of the flat wall portion (32*a*) as orthographically projected from the right is 150 $mm^2$ or more; for example, 200 $mm^2$ or more. The reinforcement projection portion (30) assumes the form of a partial sphere which partially constitutes a sphere. The inner and outer surfaces of the reinforcement projection portion (30) assume the form of a partial sphere. Preferably, the projected area (the area of a hatched portion in FIG. 6(*c*)) of the reinforcement projection portion (30) as orthographically projected from the right is 2.8% or more and 50% or less the projected area of the flat wall portion (32*a*), but is not limited thereto.

In the present embodiment, the bottom walls of the recess portions (33) and (34) of the rear cap (18*b*) of the left-hand closing member (18); i.e., the flat wall portions (33*a*) and (34*a*) which close the left end opening of the header body (20), each have a projected area of less than 150 $mm^2$ as orthographically projected from the right. Thus, no reinforcement projection portion is formed thereon. However, in order to further enhance withstand pressure of the evaporator, an inwardly projecting reinforcement projection portion may also be formed on the flat wall portions (33*a*) and (34*a*). In the case where the flat wall portions (33*a*) and (34*a*) have a projected area of 150 $mm^2$ or more as orthographically projected from the right, an inwardly projecting reinforcement projection portion is formed thereon.

The first and second members (16) and (17) of the refrigerant inlet/outlet tank (2), the closing members (18) and (19), and the pipe joint member (21) are brazed together as follows. In assembly of the first and second members (16) and (17), the projections (27*a*) of the second member (17) are inserted into the corresponding through holes (25) of the first member (16), followed by crimping. As a result, upper end portions of the front and rear rising walls (22*a*) of the first member (16) are fitted to corresponding lower end portions of the front and rear walls (26) of the second member (17). In the thus-established condition, the first and second members (16) and (17) are brazed together by utilization of the brazing material layers of the first member (16). In attachment of the closing members (18) and (19), the recess portions (32) and (37) of the front caps (18*a*) and (19*a*), respectively, are fitted into the header body (10); the upper recess portions (33) and (38) of the rear caps (18*b*) and (19*b*), respectively, are fitted into the upper space of the header body (20) located above the flow-dividing resistance plate (29); the lower recess portions (34) and (39) of the rear caps (18*b*) and (19*b*), respectively, are fitted into the lower space of the header body (20) located under the flow-dividing resistance plate (29); the upper engagement fingers (35) and (41) are fitted to the connection walls (28) of the second member (17); and the lower engagement fingers (36) and (42) are fitted to the curved portions (22) of the first member (16). In the thus-established condition, the closing members (18) and (19) are brazed to the first and second members (16) and (17) by utilization of the brazing material layers thereof. In attachment of the pipe joint member (21), the pipe joint member (21) is brazed to the right-hand closing member (19) by utilization of the brazing material layers of the right-hand closing member (19). The flow-dividing resistance plate (29) divides the interior of the refrigerant outlet header (6) into the upper and lower spaces (6*a*) and (6*b*). The spaces (6*a*) and (6*b*) communicate with each other through the refrigerant passage holes (31A) and (31B). The refrigerant outlet (44) of the right-hand closing member (19) communicates with the upper space (6*a*) of the refrigerant outlet header (6). The refrigerant inflow port (45) of the pipe joint member (21) communicates with the refrigerant inlet (43), and the refrigerant outflow port (46) communicates with the refrigerant outlet (44).

Figure 7:
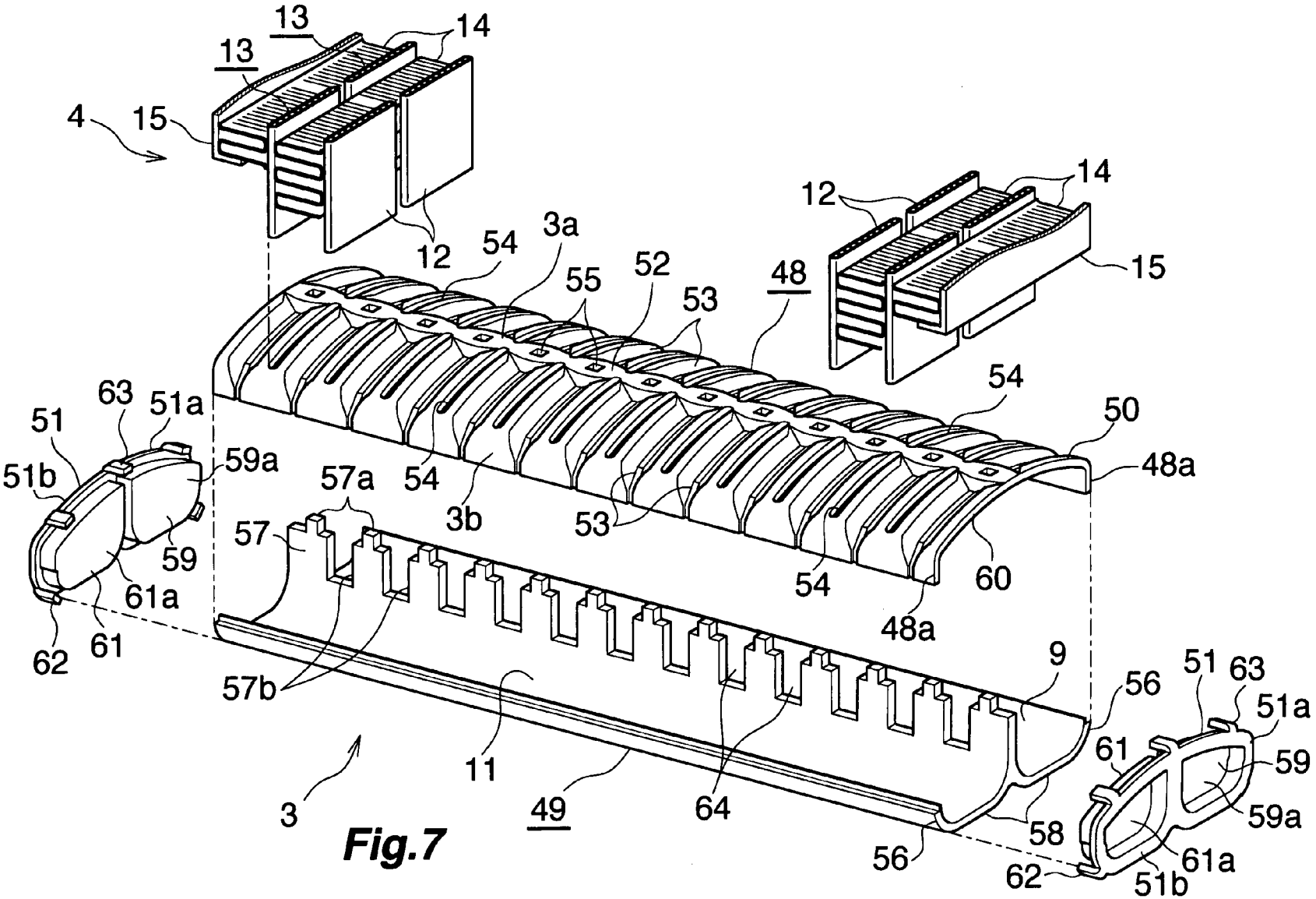
FIG. 7 is an exploded perspective view of a refrigerant turn tank of the evaporator shown in FIG. 1.
Figure 8:
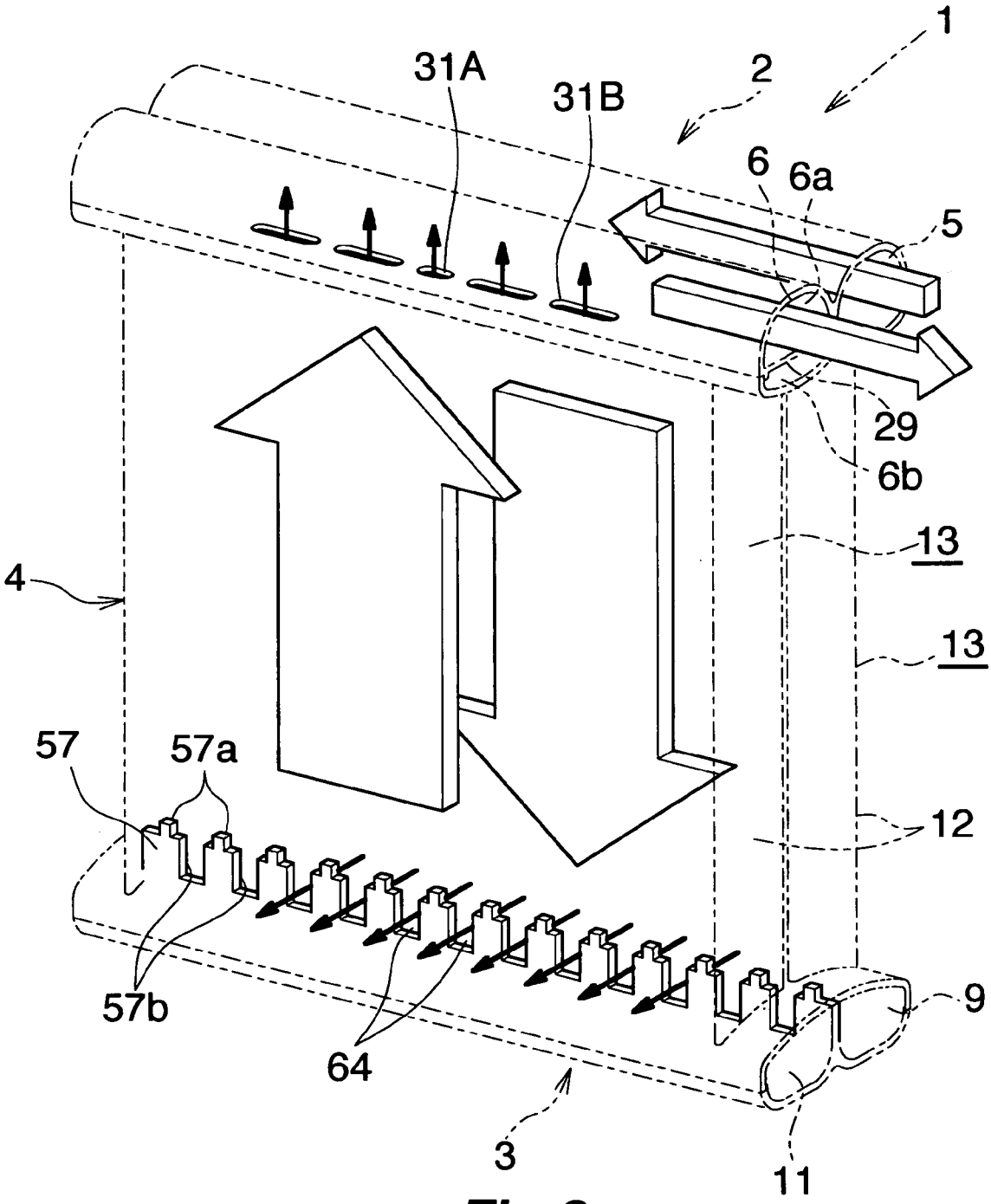
FIG. 8 is a diagram showing the flow of a refrigerant in the evaporator shown in FIG. 1.

As shown in FIGS. 3 and 7, a top face (3*a*) of the refrigerant turn tank (3) has such an arcuate cross section that a central portion thereof with respect to the front-rear direction serves as a top portion (52) and that height gradually decreases from the top portion (52) toward the front and rear sides. A plurality of grooves (53) are formed on front and rear side portions of the refrigerant turn tank (3) in such a manner as to be arranged at predetermined intervals along the left-right direction and to extend from the front and rear sides of the top portion (52) of the top face (3*a*) to front and rear side surfaces (3*b*). The refrigerant turn tank (3) is formed from an aluminum brazing sheet having a brazing material layer on each of opposite sides thereof and includes a first member (48) having a plate-like shape and to which the heat exchange tubes (12) are connected, and a second member (49) formed from a bare aluminum extrudate and covering the lower side of the first member (48).

The first member (48) has an arcuate cross section such that a central portion thereof with respect to the front-rear direction projects upward. Vertical walls (48*a*) are formed integrally with front and rear side edges of the central portion of the first member (48) over the entire length thereof. The upper surface of the first member (48) serves as the top face (3*a*) of the refrigerant turn tank (3). The outer surfaces of the vertical walls (48*a*) serve as the front and rear side surfaces (3*b*) of the refrigerant turn tank (3). The grooves (53) are formed at the front and rear sides of the first member (48) in such a manner as to extend between the top portion (52) located at the center with respect to the front-rear direction and the lower end of each of the vertical walls (48*a*). A plurality of tube insertion holes (54) elongated in the front-rear direction are each formed between the adjacent grooves (53) at front and rear side portions of the first member (48); i.e., at the remainder of the first member (48) after elimination of the top portion (52). The front tube insertion holes (54) and the rear tube insertion holes (54) are identical in position in the left-right direction. The top portion (52) of the first member (48) serves as means for connecting together the refrigerant inflow header (9) and the refrigerant outflow header (11). A plurality of through holes (55) are formed in the top portion (52) at predetermined intervals in the left-right direction.

The second member (49) has a cross section resembling the letter w, which opens upward, and includes front and rear walls (56) curved upward and toward the outside with respect to the front-rear direction and extending in the left-right direction; a vertical, intermediate wall (57) provided at a central portion thereof between the front and rear walls (56), extending in the left-right direction, and serving as means for connecting together the refrigerant inflow header (9) and the refrigerant outflow header (11); and two connection walls (58) integrally connecting the lower end of the intermediate wall (57) and the lower ends of the front and rear walls (56). The top end of the intermediate wall (57) projects upward beyond the top ends of the front and rear walls (56). A plurality of projections (57*a*) projecting upward and to be fitted into the corresponding through holes (55) of the first member (48) are formed integrally with the top end of the intermediate wall (57) at predetermined intervals in the left-right direction. Refrigerant passage cutouts (57*b*) are formed in the intermediate wall (57) between the adjacent projections (57*a*) in such a manner as to extend from its upper edges. The projections (57*a*) and the cutouts (57*b*) are formed by cutting out predetermined portions of the intermediate wall (57).

A front half of the first member (48), the front wall (56) of the second member (49), the intermediate wall (57), and the front connection wall (58) form a header body (50) of the refrigerant inflow header (9). A rear half of the first member (48), the rear wall (56) of the second member (49), the intermediate wall (57), and the rear connection wall (58) form a header body (60) of the refrigerant outflow header (11). The header bodies (50) and (60) are united together via connection means composed of the top portion (52) and the intermediate wall (57).

The opposite end openings of the header bodies (50) and (60) are closed by corresponding closing members (51) each being formed from an aluminum brazing sheet having a brazing material layer on each of opposite sides thereof. The closing members (51) are each configured such that a front cap (51*a*) and a rear cap (51*b*) are integrated with each other. The front cap (51*a*) closes an end opening of the header body (50) of the refrigerant inflow header (9). The rear cap (51*b*) closes an end opening of the header body (60) of the refrigerant outflow header (11). A recess portion (59) which projects inward with respect to the left-right direction and is fitted into the header body (50) of the refrigerant inflow header (9) is formed integrally with the front cap (51*a*) of the closing member (51). A recess portion (61) which projects inward with respect to the left-right direction and is fitted into the header body (60) of the refrigerant outflow header (11) is formed integrally with the rear cap (51*b*) of the closing member (51). The bottom walls of the recess portions (59) and (61) serve as flat wall portions (59*a*) and (61*a*) which close the end openings of the header bodies (50) and (60). Since the flat wall portions (59*a*) and (61*a*) each have a projected area of less than 150 $mm^2$ as orthographically projected from the left or the right, no reinforcement projection portion is formed thereon. However, in order to further enhance withstand pressure of the evaporator, an inwardly projecting reinforcement projection portion may also be formed on the flat wall portions (59*a*) and (61*a*). In the case where the flat wall portions (59*a*) and (61*a*) have a projected area of 150 $mm^2$ or more as orthographically projected from the left or the right, an inwardly projecting reinforcement projection portion is formed thereon.

An engagement finger (62) projecting inward with respect to the left-right direction and engaging with the corresponding front or rear wall (56) of the second member (49) is formed integrally with each of an arcuate portion extending between the front side edge and the bottom edge of each of the closing members (51) and an arcuate portion extending between the rear side edge and the bottom edge of each of the closing members (51). Similarly, a plurality of engagement fingers (63) projecting inward with respect to the left-right direction and engaging with the first member (48) are formed integrally with the top edge of each of the closing members (51).

The first and second members (48) and (49) of the refrigerant return tank (3) and the two closing members (51) are brazed together as follows. In assembly of the first and second members (48) and (49), the projections (57*a*) of the second member (49) are inserted into the corresponding through holes (55), followed by crimping. As a result, lower end portions of the front and rear vertical walls (48*a*) of the first member (48) are fitted to corresponding upper end portions of the front and rear walls (56) of the second member (49). In the thus-established condition, the first and second members (48) and (49) are brazed together by utilization of the brazing material layers of the first member (48). In attachment of the two closing members (51), the recess portions (59) of the front caps (51*a*) are fitted into the header body (50); the recess portions (61) of the rear caps (51*b*) are fitted into the header body (60); the upper engagement fingers (63) are fitted to the first member (48); and the lower engagement fingers (62) are fitted to the front and rear walls (56) of the second member (49). In the thus-established condition, the two closing members (51) are brazed to the first and second members (48) and (49) by utilization of the brazing material layers thereof. The first member (48) closes the upper end openings of the cutouts (57*b*) of the intermediate wall (57) of the second member (49), thereby forming refrigerant passage holes (64).

Each of the heat exchange tubes (12) which constitute the front and rear heat exchange tube groups (13) is formed from a bare aluminum extrudate and assumes a flat form having a wide width in the front-rear direction. In the heat exchange tube (12), a plurality of refrigerant channels (12*a*) extending in the longitudinal direction thereof are formed in parallel therein. Upper end portions of the heat exchange tubes (12) are inserted into the corresponding tube insertion holes (23) of the first member (16) of the refrigerant inlet/outlet tank (2) and brazed to the first member (16) by utilization of the brazing material layers of the first member (16). Lower end portions of the heat exchange tubes (12) are inserted into the corresponding tube insertion holes (54) of the first member (48) of the refrigerant turn tank (3) and brazed to the first member (48) by utilization of the brazing material layers of the first member (48).

Preferably, the thickness of the heat exchange tube (12) as measured in the left-right direction; i.e., a tube height, is 0.75 mm to 1.5 mm; the width of the heat exchange tube (12) as measured in the front-rear direction is 12 mm to 18 mm; the wall thickness of the heat exchange tube (12) is 0.175 mm to 0.275 mm; the thickness of a partition wall separating the refrigerant channels from each other is 0.175 mm to 0.275 mm; the pitch of the partition walls is 0.5 mm to 3.0 mm; and the front and rear end walls each have a radius of curvature of 0.35 mm to 0.75 mm as measured on the outer surface thereof.

In place of use of the heat exchange tube (12) formed from an aluminum extrudate, a heat exchange tube to be used may be formed such that an inner fin is inserted into a seam welded pipe of aluminum so as to form a plurality of refrigerant channels therein. Alternatively, a heat exchange tube to be used may be formed as follows. An aluminum brazing sheet having a brazing material layer on a single side thereof is subjected to a rolling process which is performed on the side where the brazing material is present, so as to form a plate which includes two flat-wall-forming portions connected together via a connection portion; side-wall-forming portions, which are formed, in a bulging condition, integrally with the corresponding flat-wall-forming portions at their side edges located in opposition to the connection portion; and a plurality of partition-wall-forming portions, which are formed integrally with the flat-wall-forming portions in such a manner as to project from the flat-wall-forming portions, and to be arranged at predetermined intervals in the width direction of the flat-wall-forming portions. The thus-prepared plate is bent at the connection portion into a hairpin form such that the side-wall-forming portions abut each other, followed by brazing. The partition-wall-forming portions become partition walls.

Each of the corrugated fins (14) is made in a wavy form from an aluminum brazing sheet having a brazing material layer over opposite surfaces thereof. The corrugate fin (14) includes wave crest portions, wave trough portions, and connection portions each connecting together the wave crest portion and the wave trough portion. A plurality of louvers are formed at the connection portions in such a manner as to be juxtaposed in the front-rear direction. The front and rear heat exchange tube groups (13) share the corrugate fin (14). The width of the corrugate fin (14) as measured in the front-rear direction is substantially equal to the span between the front ends of the heat exchange tubes (12) of the front heat exchange tube group (13) and the rear end of the heat exchange tubes (12) of the rear heat exchange tube group (13). Instead of a single corrugate fin being shared between the front and rear heat exchange tube groups (13), a corrugate fin may be disposed between the adjacent heat exchange tubes (12) of each of the front and rear heat exchange tube groups (13). The fin height of the corrugate fin (14) means a direct distance between the wave crest portion and the wave trough portion. Preferably, the fin height is 7.0 mm to 10.0 mm. The fin pitch of the corrugate fin (14) means ½ the distance between vertically central portions of adjacent wave crest portions or between vertically central portions of adjacent wave trough portions. Preferably, the pitch is 1.3 mm to 1.8 mm.

In manufacture of the evaporator (1), component members thereof excluding the refrigerant inlet pipe (7) and the refrigerant outlet pipe (8) are assembled and tacked together, and the resultant assembly is subjected to batch brazing.

The evaporator (1), together with a compressor, a condenser, and an expansion valve (pressure-reducing device), constitutes a refrigeration cycle which uses a chlorofluorocarbon-based refrigerant. The refrigeration cycle is installed in a vehicle, for example, an automobile, as a car air conditioner.

In the evaporator (1) described above, as shown in FIG. 8, two-phase refrigerant of vapor-liquid phase having passed through a compressor, a condenser, and an expansion valve (pressure-reducing device) enters the refrigerant inlet header (5) from the refrigerant inlet pipe (7) through the refrigerant inflow port (45) of the pipe joint member (21) and the refrigerant inlet (43) of the front cap (19*a*) of the right-hand closing member (19). Then, the refrigerant dividedly flows into the refrigerant channels (12*a*) of all of the heat exchange tubes (12) of the front heat exchange tube group (13).

The refrigerant having entered the refrigerant channels (12*a*) of all the heat exchange tubes (12) flows downward through the refrigerant channels (12*a*) and enters the refrigerant inflow header (9) of the refrigerant turn tank (3). The refrigerant having entered the refrigerant inflow header (9) passes through the refrigerant passage holes (64) of the intermediate wall (57) and enters the refrigerant outflow header (11).

The refrigerant having entered the refrigerant outflow header (11) dividedly flows into the refrigerant channels (12*a*) of all the heat exchange tubes (12) of the rear heat exchange tube group (13); flows upward, in opposition to the previous flow direction, through the refrigerant channels (12*a*); and enters the lower space (6*b*) of the refrigerant outlet header (6). Since the flow-dividing resistance plate (29) imparts resistance to the flow of the refrigerant, the divided flow from the refrigerant outflow header (11) to all the heat exchange tubes (12) of the rear heat exchange tube group (13) becomes uniform, and the divided flow from the refrigerant inlet header (5) to all the heat exchange tubes (12) of the front heat exchange tube group (13) becomes uniform to a greater extent. As a result, the refrigerant flow rate becomes uniform among all the heat exchange tubes (12) of the two heat exchange tube groups (13).

Then, the refrigerant passes through the refrigerant passage holes (31A) and (31B) of the flow-dividing resistance plate (29) and enters the upper space (6*a*) of the refrigerant outlet header (6). Subsequently, the refrigerant flows out to the refrigerant outlet pipe (8) through the refrigerant outlet (44) of the rear cap (19*b*) of the right-hand closing member (19) and the refrigerant outflow port (46) of the pipe joint member (21). While flowing through the refrigerant channels (12*a*) of the heat exchange tubes (12) of the front heat exchange tube group (13) and through the refrigerant channels (12*a*) of the heat exchange tubes (12) of the rear heat exchange tube group (13), the refrigerant is subjected to heat exchange with the air flowing through the air-passing clearances in the direction of arrow X shown in FIG. 1 and flows out from the evaporator (1) in a vapor phase.

During the heat exchange, condensed water is generated on the surface of the corrugate fins (14). The condensed water flows downward onto the top face (3*a*) of the refrigerant turn tank (3). Then, the condensed water, by the capillary effect, enters the grooves (53); flows through the grooves (53); and drops downward below the refrigerant turn tank (3) from front and rear end portions of the grooves (53). This mechanism prevents freezing of condensed water which could otherwise result from stagnation of condensed water in a large amount in the regions between the top face (3*a*) of the refrigerant turn tank (3) and the bottom ends of the corrugate fins (14). As a result, a drop in performance of the evaporator (1) is prevented.

In the above-described embodiment, a single heat exchange tube group (13) is provided between the refrigerant inlet header (5) and the refrigerant inflow header (9) of the tanks (2) and (3), respectively, and a single heat exchange tube group (13) is provided between the refrigerant outlet header (6) and the refrigerant outflow header (11) of the tanks (2) and (3), respectively. However, the present invention is not limited thereto. For example, the following configuration may be employed: one or more heat exchange groups (13) are provided between the refrigerant inlet header (5) and the refrigerant inflow header (9) of the tanks (2) and (3), respectively; and one or more heat exchange groups (13) are provided between the refrigerant outlet header (6) and the refrigerant outflow header (11) of the tanks (2) and (3), respectively. Also, the refrigerant turn tank may be located above the refrigerant inlet/outlet tank.

In the above-described embodiment, in order to enhance drainage performance, the refrigerant turn tank (3) has the grooves (53) formed in regions between the adjacent heat exchange tubes (12). However, the present invention is not limited thereto. Grooves for enhancing drainage performance may be formed at positions corresponding to the heat exchange tubes (12). In this case, in a region of the refrigerant turn tank (3) extending from the top face (3*a*) to the front and rear side surfaces (3*b*), grooves for enhancing drainage performance are formed from the outer ends, with respect to the front-rear direction, of the tube insertion holes (54).

The above embodiment is described while mentioning the heat exchanger applied to an evaporator of a car air conditioner which uses a chlorofluorocarbon-based refrigerant. However, the present invention is not limited thereto. The heat exchanger of the present invention may be used as an evaporator of a car air conditioner used in a vehicle, for example, an automobile, the car air conditioner including a compressor, a gas cooler, an intermediate heat exchanger, an expansion valve (pressure-reducing device), and an evaporator and using a $CO_2$ refrigerant.

What is claimed is:

1. A heat exchanger comprising:

a heat exchange core section configured such that heat exchange tube groups are arranged in a plurality of rows in an air flow direction, each heat exchange tube group comprising a plurality of heat exchange tubes arranged at predetermined intervals, a first header which is disposed on a first-end side of the heat exchange tubes and to which the heat exchange tubes of at least one heat exchange tube group are connected, a second header which is disposed on the first-end side of the heat exchange tubes and upstream of the first header with respect to the air flow direction and to which the heat exchange tubes of the remaining heat exchange tube groups are connected, a third header which is disposed on a second-end side of the heat exchange tubes and to which the heat exchange tubes connected to the first header are connected, and a fourth header which is disposed on the second-end side of the heat exchange tubes and to which the heat exchange tubes connected to the second header are connected, wherein the headers each comprise a hollow header body having opposite ends opened, and caps each having a flat wall portion and fixed to the corresponding opposite ends of the header body, the flat wall portions closing the corresponding opposite end openings of the header body, a reinforcement projection portion projecting toward the interior of the header is formed on the flat wall portion of at least one of the caps, a refrigerant inlet is formed in the cap which closes a first end opening of the header body of the first header, a refrigerant outlet is formed in the cap which closes an end opening, which corresponds to the first end opening of the header body of the first header, of the header body of the second header, the third header and the fourth header communicate with each other, the reinforcement projection portion is formed on the flat wall portion of the cap which closes the end opening opposite the refrigerant inlet of the header body of the first header, partition means extending horizontally divides the interior of the second header into a first space and a second space, the heat exchange tubes are connected to the second header in such a manner as to communicate with the first space, refrigerant passage holes are formed in the partition means, the second space of the second header communicates with the refrigerant outlet, a recess portion to be fitted into the first space and a recess portion to be fitted into the second space are formed on the two caps which close the corresponding opposite end openings of the header body of the second header, and bottom walls of the recess portions serve as the flat wall portions which close the corresponding opposite end openings of the header body.

2. A heat exchanger according to claim 1, wherein the reinforcement projection portion is formed on the flat wall portion having a projected area of 150 $mm^2$ or more.

3. A heat exchanger according to claim 2, wherein the reinforcement projection portion is formed on the flat wall portion having a projected area of 200 $mm^2$ or more.

4. A heat exchanger according to claim 2, wherein the projected area of the reinforcement projection portion is 2.8% or more the projected area of the flat wall portion.

5. A heat exchanger according to claim 4, wherein the projected area of the reinforcement projection portion is 50% or less the projected area of the flat wall portion.

6. A heat exchanger according to claim 1, wherein the reinforcement projection portion assumes the form of a partial sphere which partially constitutes a sphere.

7. A heat exchanger according to claim 1, wherein the caps each have a recess portion to be fitted into the header body, and bottom walls of the recess portions serve as the flat wall portions which close the corresponding opposite end openings of the header bodies.

* * * * *